US011297930B1

(12) United States Patent
Rodriguez

(10) Patent No.: US 11,297,930 B1
(45) Date of Patent: Apr. 12, 2022

(54) LEG AND BRA STRAP FOR WOMEN IN FRONT OF A CAMERA

(71) Applicant: Mabrisa Rodriguez, Burlingame, CA (US)

(72) Inventor: Mabrisa Rodriguez, Burlingame, CA (US)

(73) Assignee: Mabrisa Rodriguez, San Francisco, CA (US)

( * ) Notice: Subject to any disclaimer, the term of this patent is extended or adjusted under 35 U.S.C. 154(b) by 0 days.

(21) Appl. No.: 17/031,759

(22) Filed: Sep. 24, 2020

(51) Int. Cl.
*A45F 5/02* (2006.01)

(52) U.S. Cl.
CPC ..... *A45F 5/022* (2013.01); *A45F 5/021* (2013.01); *A45F 2200/0508* (2013.01)

(58) Field of Classification Search
CPC ... A45F 5/022; A45F 5/021; A45F 2200/0508
See application file for complete search history.

(56) References Cited

U.S. PATENT DOCUMENTS 4,747,527 A * 5/1988 Trumpower, II ..... A41F 9/002 2/311
4,819,846 A * 4/1989 Hannemann ..... A45F 5/00 2/312
5,259,093 A * 11/1993 D'Annunzio ..... A41D 13/0002 224/148.4
5,413,262 A * 5/1995 Dewire ..... A41F 9/002 2/338
5,683,022 A * 11/1997 Evans ..... A41F 9/002 224/583
5,711,469 A * 1/1998 Gormley ..... A45F 5/02 224/236
5,964,386 A * 10/1999 Cote ..... A45F 5/02 224/236
6,073,823 A * 6/2000 Gordon ..... A45F 5/02 224/661
6,913,176 B1 * 7/2005 Buscemi ..... A45F 5/00 224/665
8,011,545 B2 * 9/2011 Murdoch ..... B25H 3/00 224/672
8,225,976 B2 * 7/2012 Meunier ..... A45F 5/02 224/675
9,254,031 B1 * 2/2016 Zenoff ..... A45F 5/021
9,392,862 B1 * 7/2016 Hajianpour ..... B65D 23/003
9,593,915 B2 * 3/2017 Tuggle ..... F41C 33/0209
10,080,423 B1 * 9/2018 Bandlow ..... F41C 33/008
2003/0218038 A1 * 11/2003 Chang ..... F41C 33/02 224/647
2005/0082323 A1 * 4/2005 O'Hair ..... B25H 3/00 224/219

(Continued)

*Primary Examiner* — Brian D Nash
(74) *Attorney, Agent, or Firm* — Kwan & Olynick LLP

(57) ABSTRACT

A secure and comfortable ankle, arm, thigh, knee and/or bra apparatus to keep microphone and Interruptible Foldback (IFB) boxes in place for women in front of a camera. The apparatus includes a strap, a first removable pocket, and a second removable pocket. The strap comprises a composite material and includes a securing mechanism. The first removable pocket is detachably coupled to the strap and is configured to hold an IFB. The second removable pocket is detachably coupled to the strap and is configured to hold a microphone. The second removable pocket is smaller than the first removable pocket.

20 Claims, 10 Drawing Sheets

(56) References Cited

U.S. PATENT DOCUMENTS

| | | | | |
|---|---|---|---|---|
| 2005/0205633 | A1* | 9/2005 | Godshaw | A45F 5/00 224/625 |
| 2007/0057003 | A1* | 3/2007 | Keyes | A45C 1/04 224/663 |
| 2008/0185412 | A1* | 8/2008 | Hollins | A45F 5/02 224/661 |
| 2013/0126540 | A1* | 5/2013 | Vesterby | A45C 13/28 220/737 |
| 2013/0126566 | A1* | 5/2013 | Seuk | A45F 5/00 224/223 |
| 2014/0151411 | A1* | 6/2014 | Anderson | A47G 25/08 223/88 |
| 2016/0029777 | A1* | 2/2016 | Gadams | A45F 5/00 224/222 |
| 2016/0206123 | A1* | 7/2016 | Andrieux | A45C 13/02 |
| 2016/0360870 | A1* | 12/2016 | Langenwalter | B26B 29/00 |
| 2016/0367016 | A1* | 12/2016 | Carver | A45F 5/021 |
| 2018/0279749 | A1* | 10/2018 | Quillmann | A43B 3/0031 |
| 2019/0075916 | A1* | 3/2019 | Becker | A45F 5/02 |
| 2019/0166984 | A1* | 6/2019 | Wall | A45F 5/021 |
| 2019/0281959 | A1* | 9/2019 | Castro | A44B 18/00 |
| 2019/0357606 | A1* | 11/2019 | Venekamp | A41D 13/0002 |
| 2020/0029638 | A1* | 1/2020 | Mahgerefteh | A45F 5/02 |
| 2020/0232738 | A1* | 7/2020 | LeMarbe | F41A 17/38 |
| 2020/0305528 | A1* | 10/2020 | Graves | A41F 1/008 |
| 2021/0025672 | A1* | 1/2021 | Shearer | F41C 33/041 |

* cited by examiner

LEG AND BRA STRAP FOR WOMEN IN FRONT OF A CAMERA

CROSS-REFERENCE TO RELATED APPLICATIONS

This application claims the benefit of prior application U.S. Provisional Application No. 62/897,928, filed Sep. 9, 2019, titled "LEG AND BRA STRAP FOR WOMEN IN FRONT OF A CAMERA" by Mabrisa Rodriguez, which is herein incorporated by reference in its entirety for all purposes.

TECHNICAL FIELD

The present disclosure relates generally to apparel, and more specifically to apparel for women in front of a camera.

BACKGROUND

Media plays an important part in the life of the average American. While most Americans are on the viewer side of television ("TV"), media correspondents make a living on the other side of TV, i.e., in front of the camera. However, nowadays being in front of a camera is not only important for TV, but for other media outlets as well. With the advent of social media and video bloggers ("vloggers"), hundreds of thousands of "influencers" step in front of a camera every day to share their presence and messages. One issue with being in front of a camera is the delivery of sound. For professional media correspondents, microphones and Interruptible Foldbacks (IFBs) need to be attached to the correspondent. For men, it is easy to hide the microphone and IFBs by clipping them to a collar or belt or putting it in a pocket. In addition, a sports coat or a blazer can be used to hide the microphone or IFB. For women in front of the camera, it is much harder. Since women do not always wear shirts with collars, jackets with pockets, or pants with belts, women often have to resort to creative, yet ultimately ineffective, ways to hold and hide their microphone and IFB. Thus, there exists a need for an effective means for women in front of a camera to hold and hide their microphones and IFBs.

SUMMARY

The following presents a simplified summary of the disclosure in order to provide a basic understanding of certain embodiments of the disclosure. This summary is not an extensive overview of the disclosure and it does not identify key/critical elements of the disclosure or delineate the scope of the disclosure. Its sole purpose is to present some concepts disclosed herein in a simplified form as a prelude to the more detailed description that is presented later.

In one aspect of the present disclosure, an apparatus for women to wear in front of a camera is described. The apparatus comprises a strap comprising a composite material and including a securing mechanism. The apparatus also comprises a first removable pocket detachably coupled to the strap. The first removable pocket is configured to hold an Interruptible Foldback (IFB). The apparatus also comprises a second removable pocket detachably coupled to the strap. The second removable pocket is configured to hold a microphone. The second removable pocket being smaller than the first removable pocket.

In some embodiments, the composite material comprises a combination of three layers, an outer layer, an inner layer, and a middle layer, wherein the outer and inner layers surround the middle layer. In some embodiments, the outer layer and the inner layer comprise a stretch woven fabric and the middle layer comprises a neoprene material. In some embodiments, the strap includes a fourth layer located on top of the inner layer, the fourth layer comprising an anti-slip grip material. In some embodiments, the anti-slip material comprises a silicon print. In some embodiments, the first and second removable pockets are adjustable in terms of position on the strap to adjust to different sizes of different users. In some embodiments, the apparatus comprises nude colors to match different skin tones of different users in order to be camouflaged on camera. In some embodiments, each of the first and second removable pockets is configured to include a top button strap to secure the IFB or microphone, each of the top button straps shaped such that enough room is available for on either side of the top button strap such that antennae and wires have enough room to attach to the top of either the IFB or microphone. In some embodiments, each of the first and second removable pockets include a side strap for holding down wires next to each removable pocket. In some embodiments, the first and second removable pockets are configured be at least a minimum distance of 1 foot in spacing from each other in order to prevent interference between the IFB and microphone.

In another aspect of the present disclosure, a system for holding an Interruptible Foldback (IFB) and a microphone while on camera is provided. The system comprises a strap comprising a composite material and including a securing mechanism. The system also comprises a first removable pocket detachably coupled to the strap. The first removable pocket is configured to hold an Interruptible Foldback (IFB). The system also comprises a second removable pocket detachably coupled to the strap. The second removable pocket is configured to hold a microphone. The second removable pocket being smaller than the first removable pocket.

These and other embodiments are described further below with reference to the figures.

BRIEF DESCRIPTION OF THE DRAWINGS

The disclosure may best be understood by reference to the following description taken in conjunction with the accompanying drawings, which illustrate particular embodiments of the present disclosure.

DESCRIPTION OF PARTICULAR EMBODIMENTS

Figure 1A:
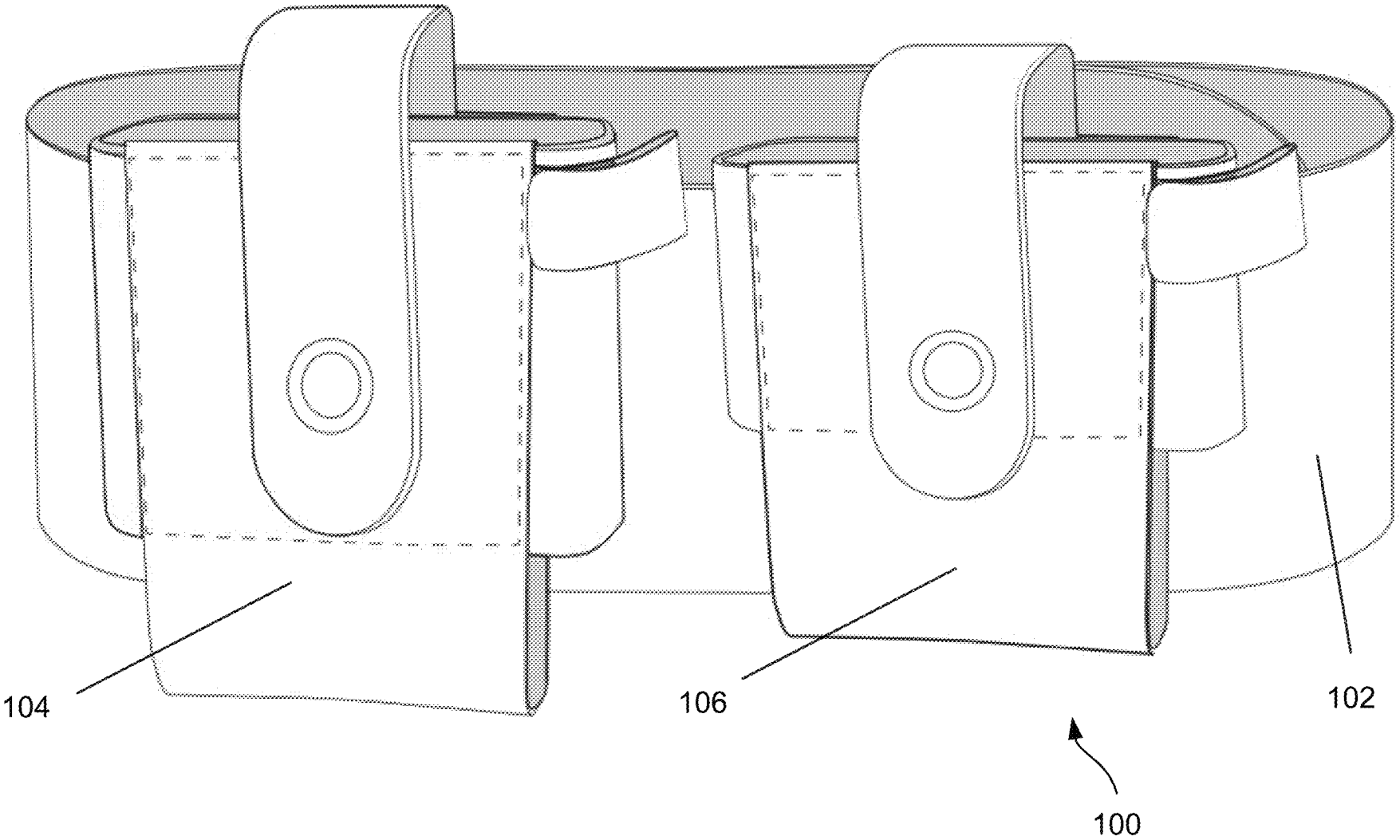
FIGS. 1A-1B illustrate an example of an apparatus for holding an IFB and microphone on while on camera, in accordance with one or more embodiments of the present disclosure.

Reference will now be made in detail to some specific examples of the present disclosure including the best modes contemplated by the inventors for carrying out the present disclosure. Examples of these specific embodiments are illustrated in the accompanying drawings. While the present disclosure is described in conjunction with these specific embodiments, it will be understood that it is not intended to limit the present disclosure to the described embodiments. On the contrary, it is intended to cover alternatives, modifications, and equivalents as may be included within the spirit and scope of the present disclosure as defined by the appended claims.

In the following description, numerous specific details are set forth in order to provide a thorough understanding of the present disclosure. Particular example embodiments of the present disclosure may be implemented without some or all of these specific details. In other instances, well known process operations have not been described in detail in order not to unnecessarily obscure the present disclosure. As used herein, the terms "user" and "wearer" will be used synonymously.

Various techniques and mechanisms of the present disclosure will sometimes be described in singular form for clarity. However, it should be noted that some embodiments include multiple iterations of a technique or multiple instantiations of a mechanism unless noted otherwise. Furthermore, the techniques and mechanisms of the present disclosure will sometimes describe a connection between two entities. It should be noted that a connection between two entities does not necessarily mean a direct, unimpeded connection, as a variety of other entities may reside between the two entities. Consequently, a connection does not necessarily mean a direct, unimpeded connection unless otherwise noted.

Overview

The general purpose of the present disclosure, which will be described subsequently in greater detail, is to provide a secure and comfortable ankle, arm, waist, leg, thigh, knee and/or bra apparatus to keep microphone and IFB boxes in place for women in front of a camera. The removable pockets will securely and effectively hold the microphone and IFB boxes in place on the strap itself. The strap is designed to stay in place with direct contact on the skin, while being durable yet comfortable to wear. The design of the apparatus is meant to be effective yet low profile.

To the accomplishment of the above and related objects, the disclosed apparatus, systems and methods may be embodied in the form illustrated in the accompanying drawings, attention being called to the fact, however, that the drawings are illustrative only, and that changes may be made in the specific construction illustrated.

DETAILED EMBODIMENTS

Currently, women in television have to resort to buying a strap that is typically gym/athletic apparel to hook the microphone and IFB apparatus to the leg. Most women also resort to using their bra straps to hook microphone and IFB which is not secure and over time ruins the bra strap. Women also typically buy boots to hide microphone and IFB wires, in addition to microphone and IFB boxes in the boot. Women have also complained about getting blood clots or leg pain because they have to tighten to the gym/athletic wear strap so tightly it negatively impacts leg and blood circulation. The apparatus provided herein addresses these deficiencies in previous approaches. For example, the secure pockets safely and effectively hold the microphone and IFB in place. Also, in some embodiments, there will be an additional Velcro strap to secure wires from sticking out and/or coming loose. In some embodiments, there will also be a rubber grip in the strap for additional secure placement of the strap itself onto the leg and bra. According to various embodiments, the bra strap will go over a woman's bra strap in order not to damage the original bra strap. In such embodiments, the strap will also feature pockets to secure microphone and IFB boxes and wires behind a woman's back should they prefer the bra embodiment over the leg embodiment, or in addition to the leg embodiment. In some embodiments, if a woman chooses to not wear a bra, an additional strap will be supplied in place of the bra strap to secure pockets for microphone and IFB.

The apparatus and methods described herein will allow women to give speeches and present information in front of a camera without having to worry about microphone and IFB placement. The apparatus will comfortably allow women to walk around without having to worry about wires sticking out or IFB or microphone boxes falling out of the strap. The material will be comfortable, functional and durable so women can place the apparel underneath clothing without it being too noticeable.

According to various embodiments, the apparatus comes in different colors and sizes to accommodate each woman's, or man's, unique body type. The material is thin, comfortable and durable so that it is not obvious underneath a woman's clothing. The strap features an anti-slip material that will effectively grip to the skin to allow for additional support to prevent the strap from falling. Also, the grip will help women to not tighten the band so much to prevent serious leg damage like blood clots and poor blood circulation. In some embodiments, there will be secure pockets with button clasps to safely and effectively hold the microphone and IFB in place. The clasps are designed to optimize security yet minimize interference. Also, in some embodiments, there will be an additional side strap to secure wires from sticking out and/or coming loose. In some embodiments, there will also be a rubber grip in the apparatus for additional secure placement of the apparatus itself for the bra. The bra apparatus will go over a woman's bra strap to not damage the original bra strap. That apparatus will also feature pockets to secure microphone and IFB boxes and wires behind a woman's back if they prefer that over the leg apparatus, or in addition to the leg apparatus. If a woman chooses to not wear a bra an additional strap will be supplied in placement of the bra strap to secure pockets for microphone and IFB. In some embodiments, the apparatus will comprise specialized shaping underwear with strategically placed pockets for women to place underneath their clothing as an alternative to the straps.

Turning now descriptively to the drawings, in which similar reference characters denote similar elements throughout the several views, the attached figures illustrate systems and methods for automated pairing of incoming leads.

Figure 1B:
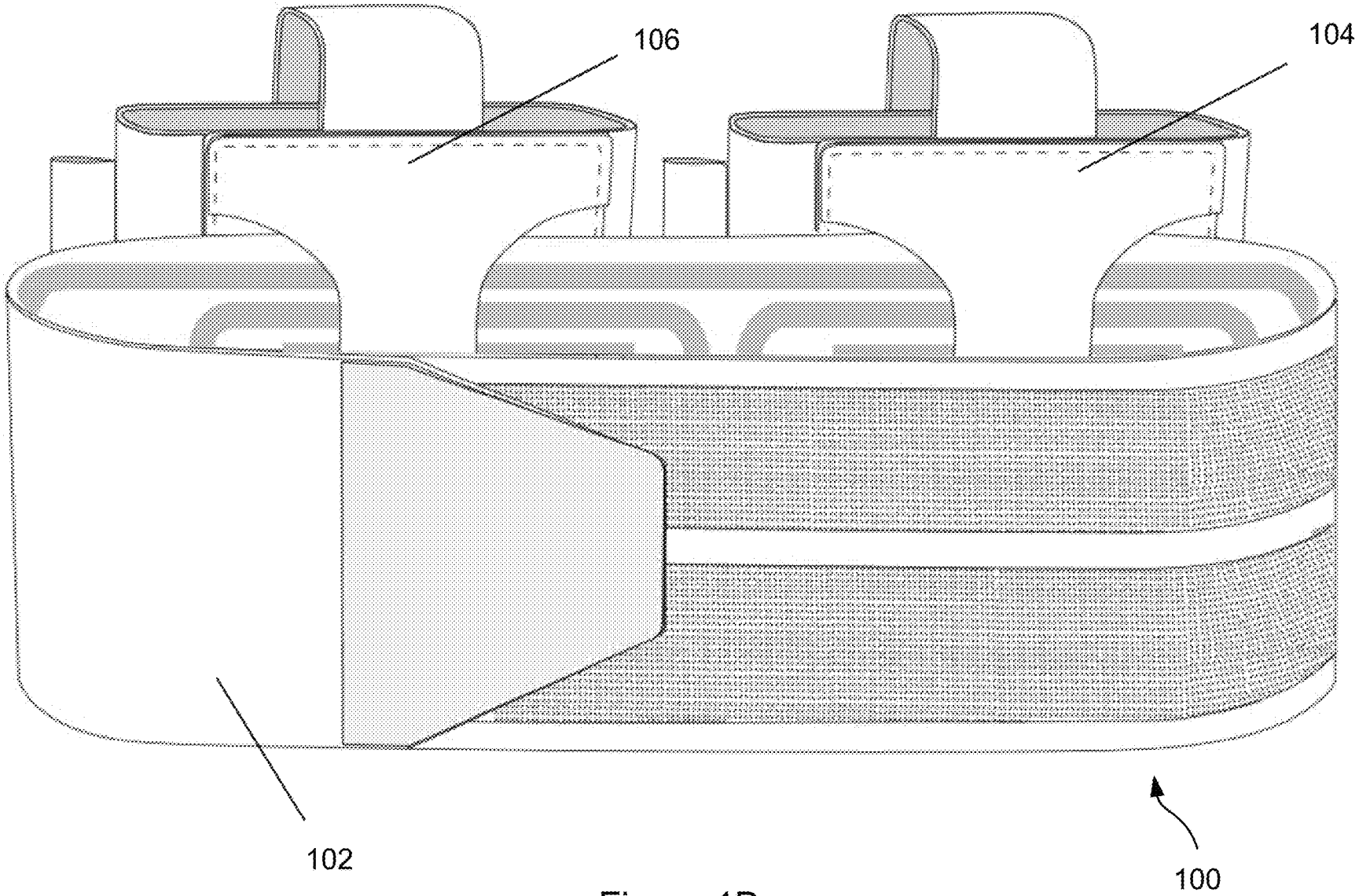

FIGS. 1A-1B illustrate an example of an apparatus for holding an IFB and microphone on while on camera, in accordance with one or more embodiments of the present disclosure. Apparatus 100 includes a strap 102, a first removable pocket 104, and a second removable pocket 106. In some embodiments, the apparatus will come in different colors and sizes to accommodate each woman's, or man's, unique body type. According to various embodiments, the material is thin, comfortable and durable so that it is not noticeable underneath a person's clothing. Inside the band there will be a slip-resistant strip for extra support. This will ensure the apparatus does not slide up or down during a live on-air performance. The anti-slip grip stays in place to ensure that the performer does not need to be constantly adjusting its position while on air. In some embodiments, the strap itself will be made up of high-quality material to give it longer life and durability. According to various embodiments, the material is soft to the touch to prevent a scratchy feeling. In some embodiments, the fabric will absorb sweat while maintaining the anti-slip grip therefore making the apparatus reliable even during sweating.

In some embodiments, strap 102 is specifically designed to be durable enough to hold the weight of an IFB and a microphone through repeated use, yet comfortable enough to wear directly onto the skin. In addition, strap 102 should also be made of a moisture absorbent material while also including an anti-slip grip such that the apparatus maintains the position on the wearer's body, even when a wearer starts sweating, without being too tight, which can cut off circulation and be very uncomfortable and even possibly result in medical issues. For example, many bands available on the market need to be tightly strapped around a wearer's arm or leg to ensure the equipment stays in place. Due to how tightly the bands need to be in order to not slip or shift around, many people have developed blood clots, cramps, poor circulation, and general discomfort and pain. In some embodiments, strap 102 is designed to specifically address these issues. A more detailed description of strap 102 is provided with reference to FIGS. 3A and 3B. In some embodiments, apparatus 100 includes only strap 102, with IFB and microphones coupled directly to the strap 102.

In some embodiments, apparatus 100 includes a first removable pocket 104 and a second removable pocket 106. In some embodiments, first removable pocket 104 is prevented from being closer than a minimum distance to second removable pocket 106. In such embodiments, this minimum distance helps with preventing interference with signals and communication between the IFB and microphone packs. In some embodiments, first removable pocket 104 is slightly larger than second removable pocket 106 in order to accommodate the larger size of the IFB unit versus the microphone unit. In some embodiments, removable pockets 104 and 106 provide an extra layer of protection and placement security on the desired body part of the wearer. In some embodiments, removable pockets 104 and 106 also include a top button strap to securely hold IFB and microphone in place, in case of movement by the user that may shift and alter the position of the equipment, in order to protect the equipment from damage. In some embodiments, the top button straps need to be configured such that it provides plenty of room on either side of the top button strap in order to accommodate for antennas, cables, and/or wires on each side of the equipment. Providing enough space is especially important to minimize noise, interruptions, and interference with the function of the equipment. A more detailed description of an example removable pocket is provided below with reference to FIGS. 2A-2D.

FIGS. 2A-2D illustrate an example of a removable pocket 200, in accordance with one or more embodiments of the present disclosure. In some embodiments, removable pocket 200 can be either removable pocket 104 or 106 in FIGS. 1A-1B. In some embodiments, removable pocket 200 is configured to secure an IFB box. IFB stands for Interruptible Foldback (IFB), also known as Interrupted Foldback, interruptible feedback, or interrupt for broadcast. It is a monitoring and cueing system used in television, filmmaking, video production, and radio broadcast for one-way communication from the director or assistant director to on-air talent or a remote location. In some embodiments, the pockets will fit most standard IFB dimensions of 3.6×2.4×0.8" (91.4×61×20.3 mm) and a weight of 7.3 oz (207 g). In some embodiments, removable pocket 200 is configured to hold a microphone pack. In some embodiments, removable pocket 200 is configured to hold any piece of equipment necessary for on camera personnel.

In some embodiments, removable pocket 200 includes a vertical pocket band 202 and a horizontal pocket band 204, which combine together to form a pocket for holding equipment, e.g., an IFB or a microphone. In some embodiments, vertical pocket band 202 comprises a non-stretch material to prevent the equipment from bouncing up and down. In some embodiments, horizontal pocket band 204 comprises a composite material that allows for slight stretch to accommodate small difference in equipment size and shape. For example, in some embodiments, horizontal pocket band 204 comprises a 2 mm thick neoprene material with stretch woven fabric bonded on both sides. In some embodiments, the material for vertical and horizontal pocket bands can be switched. For example, in some embodiments, vertical pocket band 202 can comprise a composite material, while horizontal pocket band 204 comprises a non-stretch material to prevent side-to-side movement. In some embodiments, both vertical and horizontal pocket bands can be comprised of non-stretch material or both can be comprised of composite materials.

In some embodiments, removable pocket 200 includes top button strap 206 configured to provide extra placement security in order to make sure the equipment does not move or shift around during usage, since the equipment can be very sensitive. In some embodiments, as with vertical pocket band 202, top button strap 206 is made of a non-stretch material to close and secure the pocket to prevent shifting around during usage. In some embodiments, top button strap 206 includes a locking mechanism 208 to secure top button strap 206 in place in the closed position. In some embodiments, locking mechanism 208 is a snap closure. In other embodiments, locking mechanism 208 may be some other form of closure for securing top button strap 206 in place. For example, in some embodiments, locking mechanism 208 may be Velcro, magnetic, or a clasp.

Figure 2A:
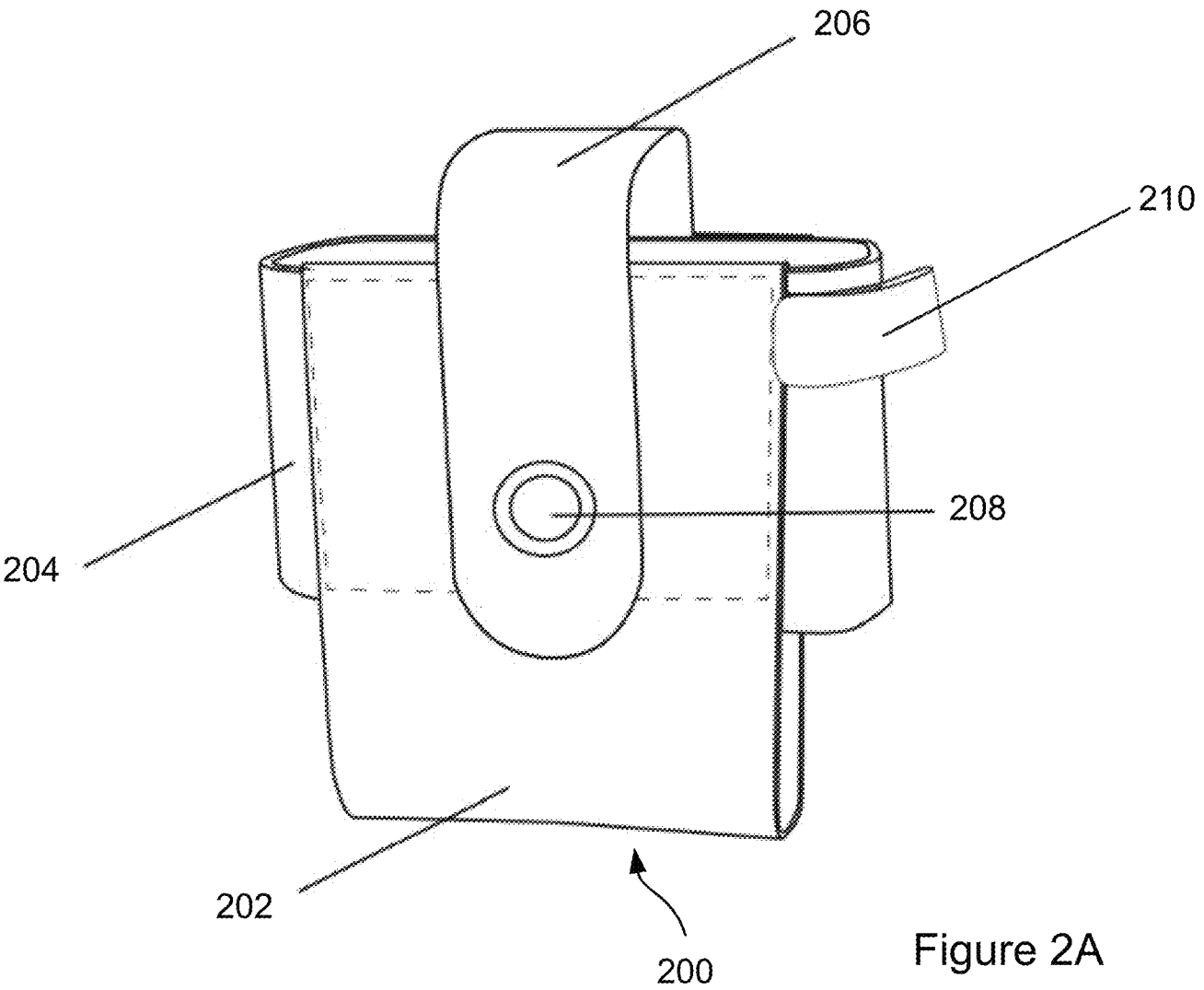
FIGS. 2A-2D illustrate an example of a removable pocket, in accordance with one or more embodiments of the present disclosure.
Figure 2B:
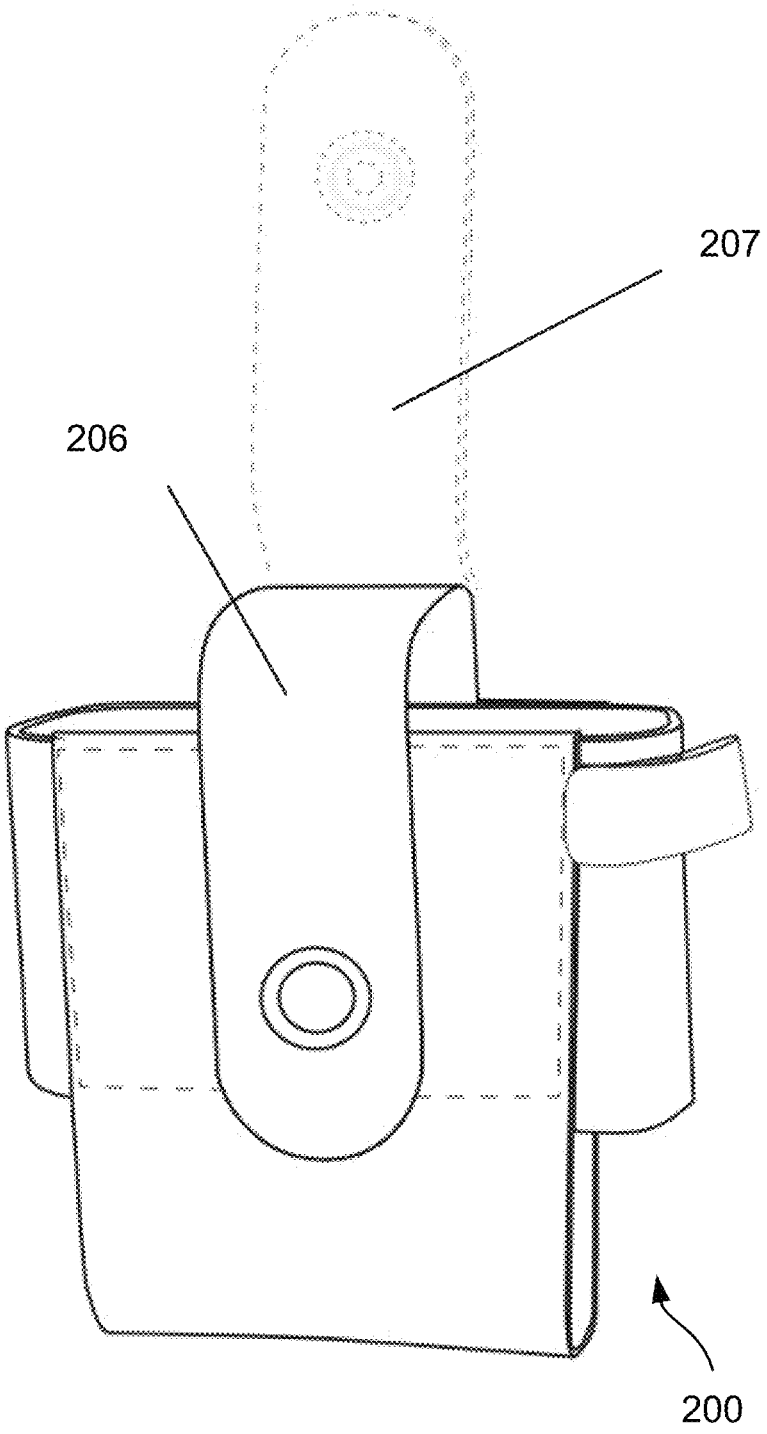

In some embodiments, once an IFB or microphone is inserted into the pocket, top button strap 206 comes over the top and secures the IFB or microphone by locking in place. FIG. 2B illustrates top button strap 206 in an unsecured position 207. In some embodiments, because either the IFB and/or microphone pack will have additional wires, cables, or antenna stick out of the top of the equipment, top button strap 206 is specifically designed to be made of durable, non-stretch material, yet needs to be thin enough width-wise to be able to leave plenty of room on either side of top button strap 206 for connection to ear piece wires, cables, and antenna. Leaving enough room for the antenna, wires, and cables to connect to the packs unhindered and unencumbered is very important for reducing interference and noise during operation.

Figure 2C:
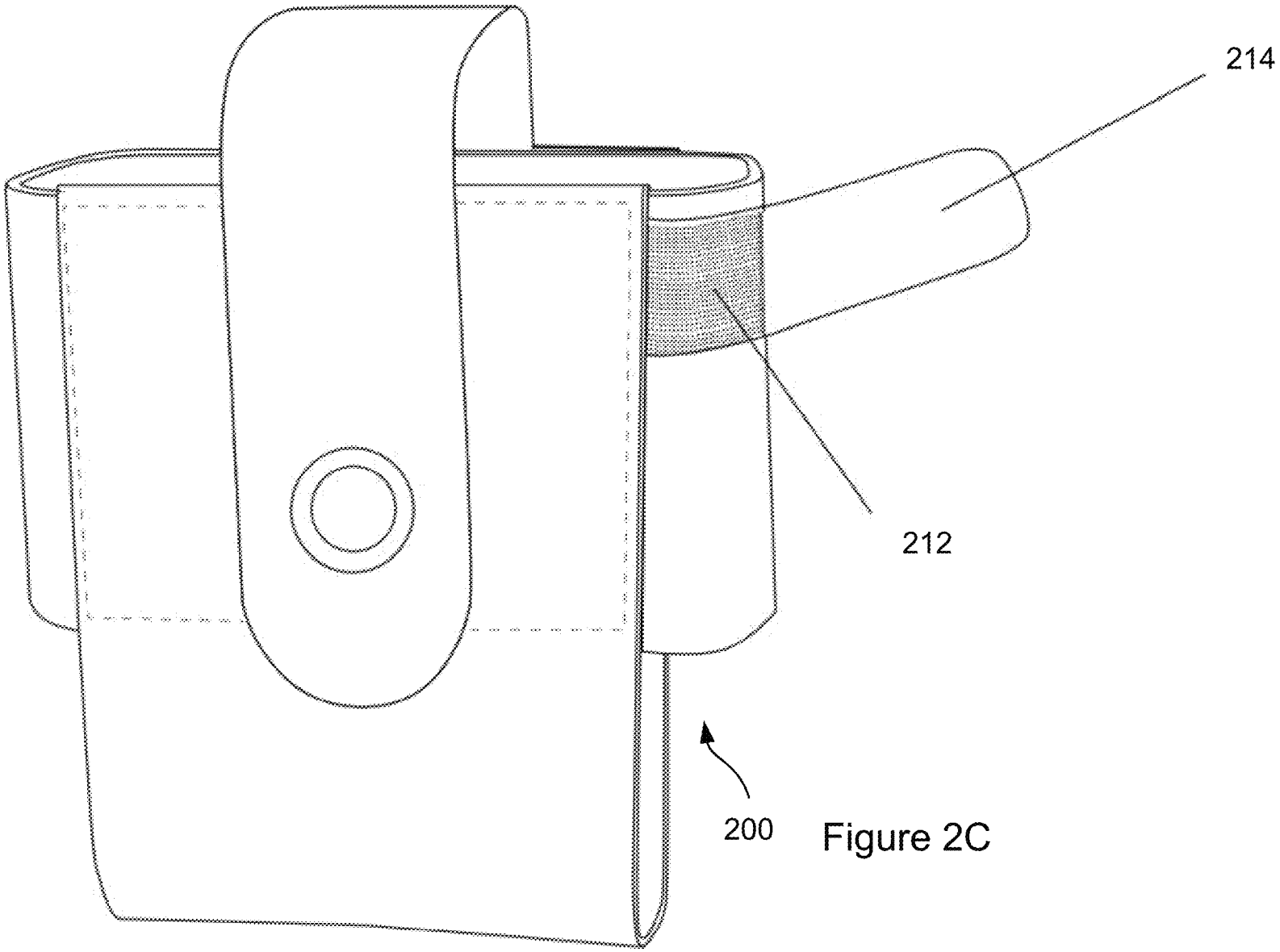

In some embodiments, removable pocket 200 includes a side strap 210, which functions to prevent any wires from sticking out, coming loose, or flowing freely where the wires can get snagged on something while the user is moving. In some embodiments, side strap 210 uses a hook-and-loop fastening mechanism. FIG. 2C illustrates side strap 210 comprising a low profile hook fastener 212 and high pile loop fastener 214. In some embodiments, side strap 210 uses a different fastening mechanism, such as a buckle or button clasp. However, the hook-and-loop fastening mechanism allows the wires to be placed in various positions and accommodates for wires of different thickness, as well as the number of wires needed to be fastened.

Figure 2D:
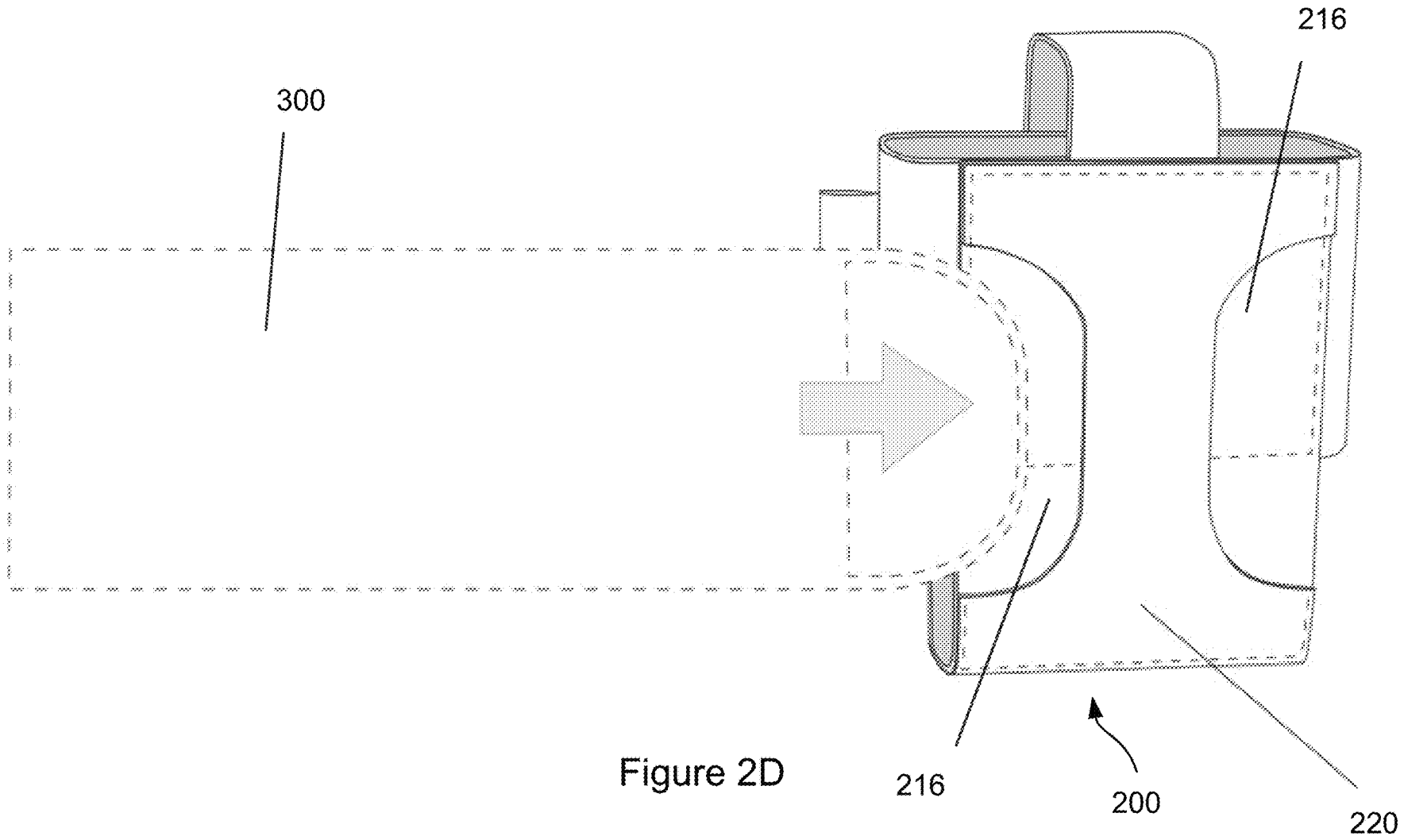

FIG. 2D illustrates a backside view of an example of a removable pocket 200. In some embodiments, the backside of removable pocket 200 includes pocket holder band loop 220. In some embodiments, pocket holder band loop 220 includes two apertures 216 on each side of the band loop for insertion and exit of a strap 300. In some embodiments, pocket holder band loop 220 comprises a non-stretch material to keep the removable pocket 200 in place during usage.

Figure 3A:
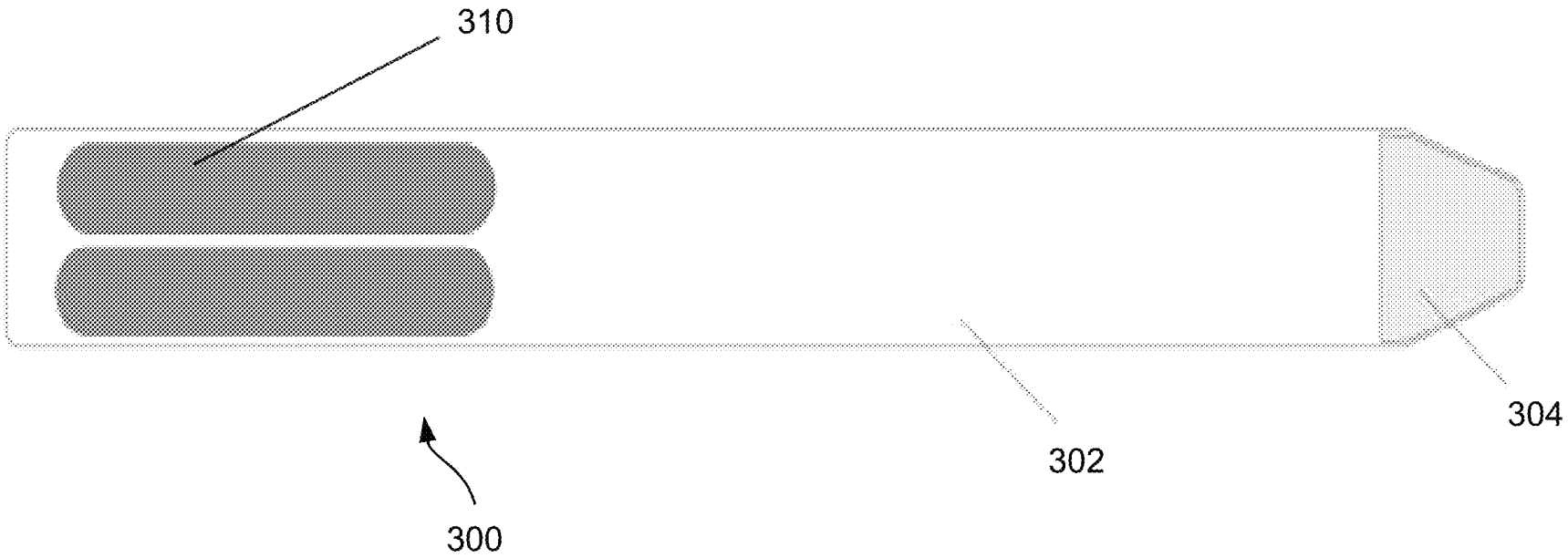
FIGS. 3A-3B illustrate an example of a strap, in accordance with one or more embodiments of the present disclosure.
Figure 3B:
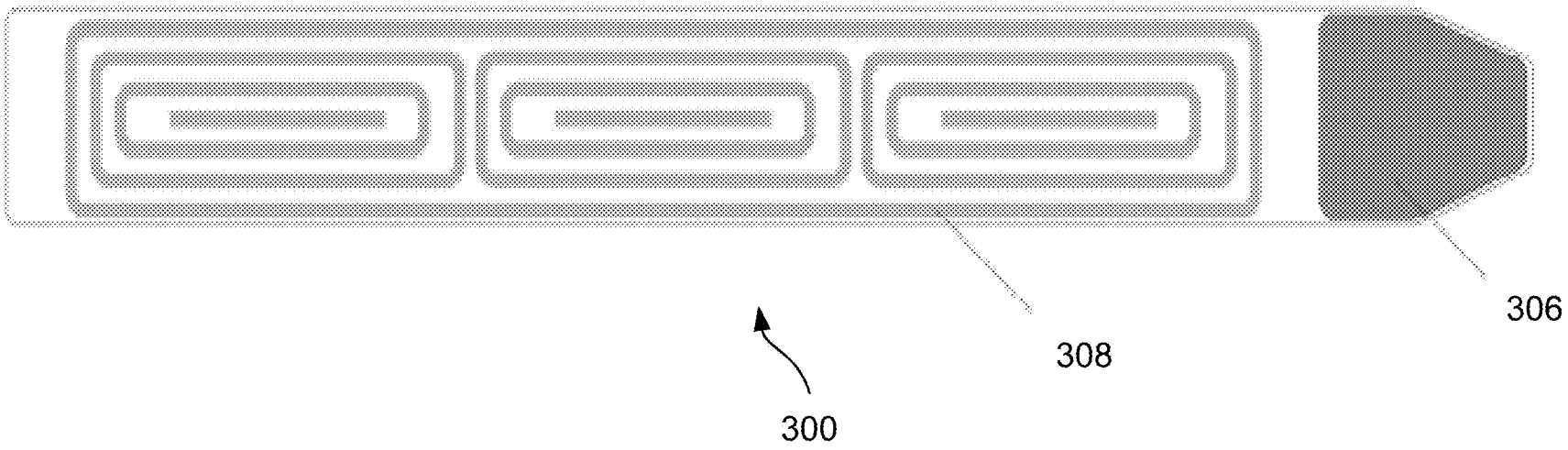

FIGS. 3A-3B illustrate an example of a strap 300, in accordance with one or more embodiments of the present disclosure. According to various embodiments, strap 300 includes a main band portion 302, an end portion 304, and an anti-slip strip 306. In some embodiments, main band portion 302 is comprised of a composite material. For example, in some embodiments, main band portion 302 can be comprised of 2 mm neoprene material with stretch woven fabric bonded on both sides. For example, main band portion can be comprised of three different layers: an outer layer, a middle layer, and an inner layer. In some embodiments, the outer and inner layers can be comprised of stretch woven fabric, which surrounds the middle layer. In some embodiments, the middle layer comprises a neoprene material, which provides extra stretch and stability. In some embodiments, the amount of neoprene material in the middle layer is derived empirically to withstand the weight of two IFB units of 400 g each, without allowing "flipping" of the strap. In other words, in some embodiments, the amount of neoprene material in the middle layer is configured such that the strap can withstand two IFB units without flipping around due to the weight of the equipment during usage. In some embodiments, the composite material allows for slight stretch to contribute to comfort during long wear periods, while maintaining the durability to hold around 800 g of equipment weight (assuming the microphone pack of the second removable pocket is as heavy as the IFB pack or less).

In some embodiments, strap 300 includes an extra protective coated tab 304 at the end of band 300, as shown in FIG. 3A. In such embodiments, such a tab prevents the edge of strap 300 from wearing off and deforming. In some embodiments, extra protective coated tab 304 comprises a polyurethane coating. In some embodiments, strap 300 also includes a low profile hook fastener 306 to fasten to high pile loop fastener 310. In some embodiments, hook fastener 306 and loop fastener 310 form a fastening mechanism for strap 300. In other embodiments, strap 300 is fastened through any other fastening mechanism, such as a button or clasp.

In some embodiments, strap 300 also includes anti-slip print 308. In some embodiments, the anti-slip print comprises a silicon material to create extra friction when in contact with human skin during wearing of 300. In some embodiments, anti-slip print 308 allows the user to wear strap 300 directly onto the skin without worry of strap 300 slipping off during usage. In some embodiments, anti-slip print 308 is arranged in a pattern, as shown in FIGS. 1B and 3B, in order to maximize the effects of moisture/sweat absorption and anti-slip grip on the skin. In other words, in some embodiments, anti-slip print 308 is printed in a pattern or configuration such that alternating sections of the anti-slip material and the stretch woven fabric maximize sweat/moisture absorption while maintaining the anti-slip properties on the skin during usage of the apparatus.

Figure 4:
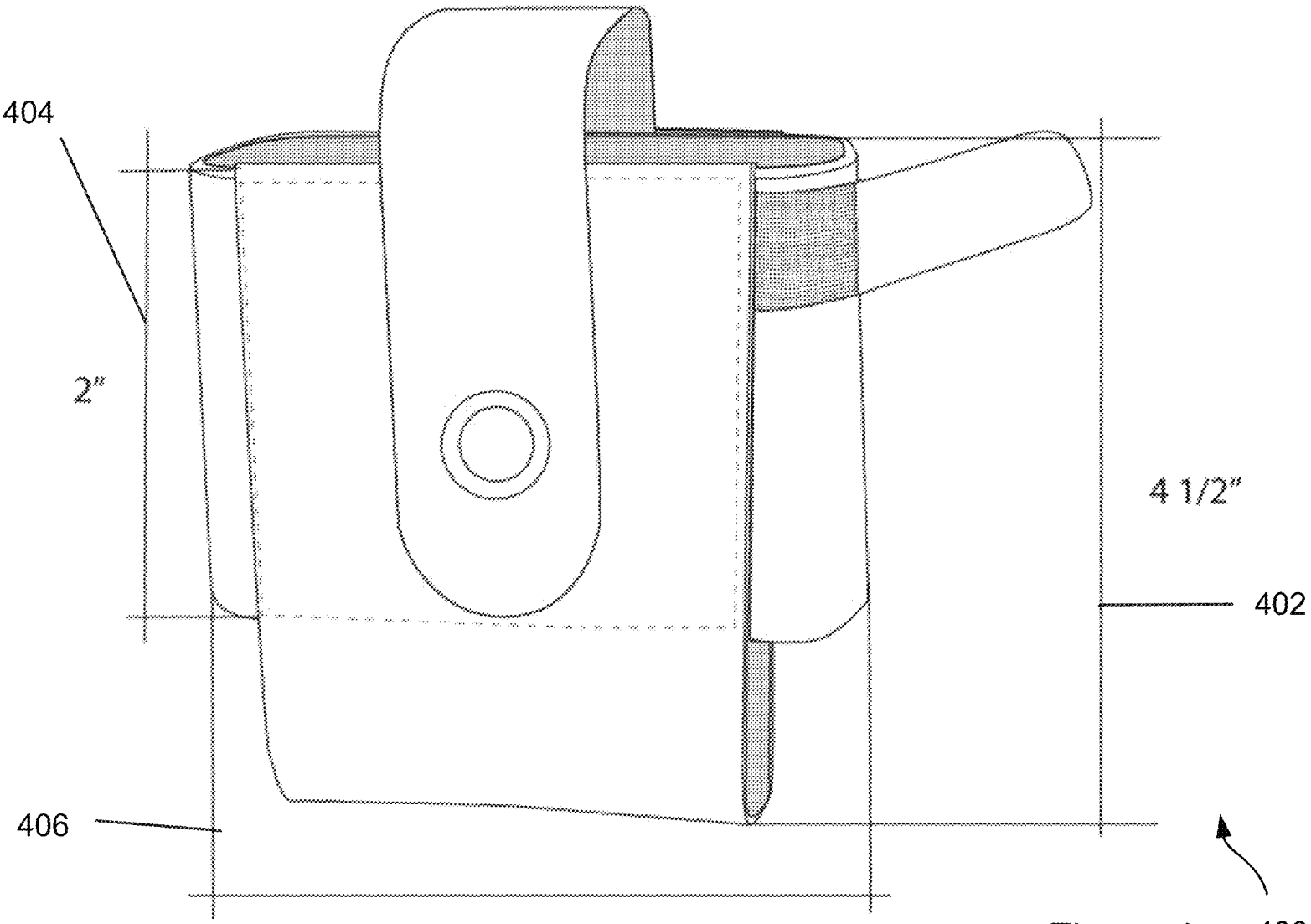
FIG. 4 illustrates an example of an IFB removable pocket with dimensions, in accordance with one or more embodiments of the present disclosure.
Figure 5:
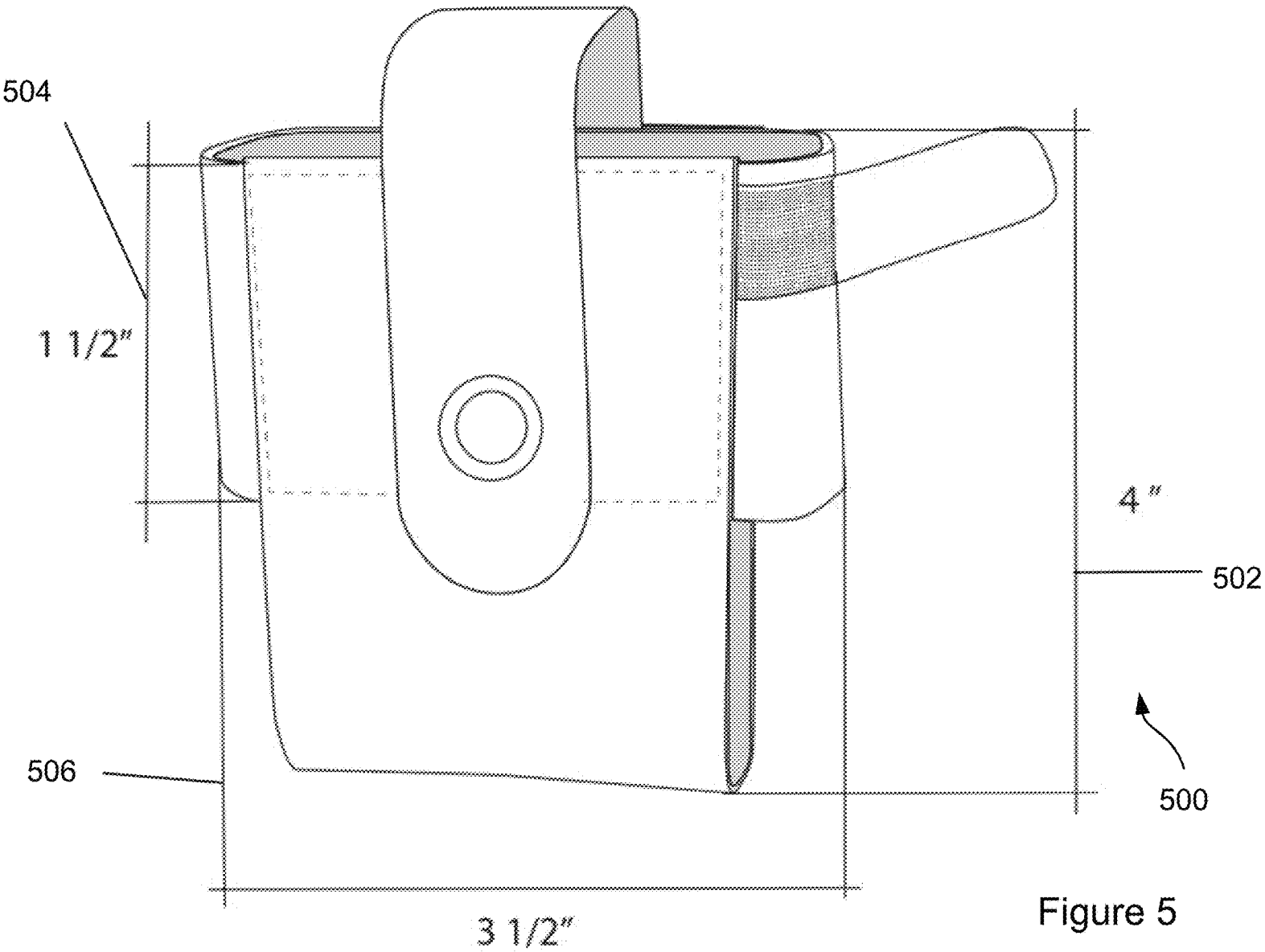
FIG. 5 illustrates an example of a microphone removable pocket with dimensions, in accordance with one or more embodiments of the present disclosure.

FIGS. 4 and 5 illustrate example dimensions for removable pockets 400 and 500, in accordance with one or more embodiments of the present disclosure. In some embodiments, removable pocket 400 illustrates dimensions for an example first removable pocket 400. In some embodiments, removable pocket 400 is designed to hold a standard IFB unit. In some embodiments, vertical pocket band length dimension 402 is 4½ inches. In some embodiments, horizontal pocket band length 404 is 2 inches. In some embodiments, the total pocket width 406 is 3¾ inches.

In some embodiments, removable pocket 500 illustrates dimensions for an example second removable pocket 500. In some embodiments, removable pocket 500 is designed to hold a standard microphone unit. In some embodiments, vertical pocket band length dimension 502 is 4 inches. In some embodiments, horizontal pocket band length 504 is 1½ inches. In some embodiments, the total pocket width 506 is 3½ inches.

Although many of the components and processes are described above in the singular for convenience, it will be appreciated by one of skill in the art that multiple components and repeated processes can also be used to practice the techniques of the present disclosure.

While the present disclosure has been particularly shown and described with reference to specific embodiments thereof, it will be understood by those skilled in the art that changes in the form and details of the disclosed embodiments may be made without departing from the spirit or scope of the disclosure. It is therefore intended that the disclosure be interpreted to include all variations and equivalents that fall within the true spirit and scope of the present disclosure.

What is claimed is:

1. An apparatus for women to wear in front of a camera comprising:

a strap comprising a composite material and including a securing mechanism, the composite material comprising a combination of three layers, an outer layer, an inner layer, and a middle layer, wherein the outer and inner layers surround the middle layer, wherein the outer layer and the inner layer comprise a stretch woven fabric and the middle layer comprises a neoprene material;

a first removable pocket detachably coupled to the strap, the first removable pocket configured to hold an Interruptible Foldback (IFB); and a second removable pocket detachably coupled to the strap, the second removable pocket configured to hold a microphone, the second removable pocket being smaller than the first removable pocket.

2. The apparatus of claim 1, wherein the strap is configured to withstand the weight of two IFB units without a portion of the strap flipping over due to the weight of the two IFB units.

3. The apparatus of claim 1, wherein the strap is configured to withstand 800 grams of equipment weight.

4. The apparatus of claim 1, wherein the strap includes a fourth layer located on top of the inner layer, the fourth layer comprising an anti-slip grip material.

5. The apparatus of claim 4, wherein the anti-slip material comprises a silicon print.

6. The apparatus of claim 1, wherein the first and second removable pockets are adjustable in terms of position on the strap to adjust to different sizes of different users.

7. The apparatus of claim 1, wherein the apparatus comprises nude colors to match different skin tones of different users in order to be camouflaged on camera.

8. The apparatus of claim 1, wherein each of the first and second removable pockets is configured to include a top button strap to secure the IFB or microphone, each of the top button straps shaped such that enough room is available for on either side of the top button strap such that antennae and wires have enough room to attach to the top of either the IFB or microphone.

9. The apparatus of claim 1, wherein each of the first and second removable pockets include a side strap for holding down wires next to each removable pocket.

10. The apparatus of claim 1, wherein the first and second removable pockets are configured be at least a minimum distance of 1 foot in spacing from each other in order to prevent interference between the IFB and microphone.

11. A system for holding an Interruptible Foldback (IFB) and a microphone while on camera, the system comprising:

a strap comprising a composite material and including a securing mechanism, the composite material comprising a combination of three layers, an outer layer, an inner layer, and a middle layer, wherein the outer and inner layers surround the middle layer, wherein the outer layer and the inner layer comprise a stretch woven fabric and the middle layer comprises a neoprene material;

a first removable pocket detachably coupled to the strap, the first removable pocket configured to hold the IFB; and a second removable pocket detachably coupled to the strap, the second removable pocket configured to hold the microphone, the second removable pocket being smaller than the first removable pocket.

12. The system of claim 11, wherein the strap is configured to withstand the weight of two IFB units without a portion of the strap flipping over due to the weight of the two IFB units.

13. The system of claim 11, wherein the strap is configured to withstand 800 grams of equipment weight.

14. The system of claim 11, wherein the strap includes a fourth layer located on top of the inner layer, the fourth layer comprising an anti-slip grip material.

15. The system of claim 14, wherein the anti-slip material comprises a silicon print.

16. The system of claim 11, wherein the first and second removable pockets are adjustable in terms of position on the strap to adjust to different sizes of different users.

17. The system of claim 11, wherein the system comprises nude colors to match different skin tones of different users in order to be camouflaged on camera.

18. The system of claim 11, wherein each of the first and second removable pockets is configured to include a top button strap to secure the IFB or microphone, each of the top button straps shaped such that enough room is available for on either side of the top button strap such that antennae and wires have enough room to attach to the top of either the IFB or microphone.

19. The system of claim 11, wherein each of the first and second removable pockets include a side strap for holding down wires next to each removable pocket.

20. The system of claim 11, wherein the first and second removable pockets are configured be at least a minimum distance of 1 foot in spacing from each other in order to prevent interference between the IFB and microphone.

* * * * *